United States Patent [19]

Scheidler et al.

[11] Patent Number: 4,772,779

[45] Date of Patent: Sep. 20, 1988

[54] GLASS-CERAMIC COOKING RANGE WITH HEATING ELEMENTS WHICH GLOW QUICKLY DURING THE HEATING-UP PHASE

[75] Inventors: Herwig Scheidler, Mainz; Kurt Schaupert, Langen; Martin Taplan, Mainz, all of Fed. Rep. of Germany

[73] Assignee: Schott Glaswerke, Mainz, Fed. Rep. of Germany

[21] Appl. No.: 946,890

[22] Filed: Dec. 29, 1986

[30] Foreign Application Priority Data

Jan. 4, 1986 [DE] Fed. Rep. of Germany ..... 3600110

[51] Int. Cl.[4] ..... H05B 3/68

[52] U.S. Cl. ..... 219/448; 219/358; 219/449; 219/452

[58] Field of Search ..... 219/448, 356, 358, 354, 219/505, 449, 450, 452

[56] References Cited

U.S. PATENT DOCUMENTS

| | | | |
|---|---|---|---|
| 2,322,162 | 6/1943 | Schmidt . | |
| 3,375,346 | 3/1968 | Gaugler et al. | 219/449 |
| 4,039,771 | 8/1977 | Thorsoe et al. | 219/505 X |
| 4,386,263 | 5/1983 | Fischer et al. | 219/452 X |
| 4,486,648 | 12/1984 | Grasso | 219/448 |
| 4,639,579 | 1/1987 | Brooks et al. | 219/354 |

FOREIGN PATENT DOCUMENTS

| | | |
|---|---|---|
| 2951409 | 7/1981 | Fed. Rep. of Germany . |
| 3327622 | 2/1985 | Fed. Rep. of Germany . |
| 3406604 | 7/1985 | Fed. Rep. of Germany . |

OTHER PUBLICATIONS

*Electrical Home Appliances: Engineering and Application*, pp. 86–89; 1959.

*Primary Examiner*—E. A. Goldberg
*Assistant Examiner*—M. M. Lateef
*Attorney, Agent, or Firm*—Barnes & Thornburg

[57] ABSTRACT

A cooking range with cooking surfaces made of glass-ceramic or comparable material, which has radiating heat elements with at least two heating circuits and suitably fitted control elements. These heating circuits are so arranged, or the heating conductors are so wired or connected by such circuitry, that in the warm-up phase one or more heat conductors are briefly overloaded so that in a very short time they begin to glow and thereby, through translucent cooking surfaces, begin to light up.

13 Claims, 3 Drawing Sheets

GLASS-CERAMIC COOKING RANGE WITH HEATING ELEMENTS WHICH GLOW QUICKLY DURING THE HEATING-UP PHASE

BACKGROUND AND SUMMARY OF THE INVENTION

The present invention concerns glass-ceramic cooktops and/or cooking ranges with radiating heating elements.

Glass-ceramic cooking ranges with radiating heating elements are already known. They are low priced and they have stood the test for years a million times over. These radiating heating elements are quite sluggish in the first minutes of warm-up. As a result of the type and design of the insulation material, and because of the type and fixation of the heating conductor (heating wire or filament), the bulk of the heating conductor and the immediately adjacent mass of insulation has to be heated up initially after the switching on of current to the heating conductor. This leads to the situation that in the first seconds after switching on the heating element, the heating conductor or coil does not glow and thus are not visible, even through a sufficiently translucent glass-ceramic cooking surface. This lack of visibility is considered to be a great disadvantage.

On the other hand, the quick visibility of the switched on heating conductor is greatly desired by the housewife, in order to be able to perceive quickly the on-condition of the heating conductor, especially to be able to perceive immediately when the heating element has been switched on mistakenly. At least for this reason, heating elements for glass-ceramic cooking ranges have been developed with halogen lamps, where the halogen lamp lights up brightly immediately following the switching on of current to the corresponding heating conductor. The big disadvantage of these halogen lamps, and the manufactured heating elements employing such lamps is that they are very expensive and that special heating element geometries or designs are not possible because of the rod-shaped halogen lamps.

The goal of the present invention is a glass-ceramic cooking range, which is so constructed, and whose heating elements are electrically so configured, that the disadvantageous sluggishness of the radiating heating element during the warm-up phase is circumvented, whereby the high costs of heating elements with halogen lamps are avoided and simultaneously the hitherto diversity of heating element geometries and designs can be retained. This goal is achieved with a cooking range having cooking surfaces made of glass-ceramic or comparable material, with radiating heating elements with at least two heating circuits and with suitably related control elements. The heating circuit in the radiating heating element is so designed, or, the heating conductors of the radiating heating element are so wired and/or are connected by such circuitry and that a suitable switch element is connected to the heating circuits, that in the first heating-up phase, one or more heat conductors are in a short time so overloadable—referring to its rated power output—that in less than 20 seconds, and preferably in less than 5 seconds, it starts to glow and thus, through the sufficiently transparent cooking surface, becomes luminous. Through the suitably connected switch element, after a preselected time and/or after a preselected temperature of the heating conductor is reached, the heating output (wattage) of one or more of the heating circuits can, by one or more grades, be reduced to a lower output in such a way, that during the continuous operation of the radiating heating element following the heat-up phase, an overloading of the heating conductor is avoided.

An advantageous arrangement of a cooking range according to the present invention provides for an external switch, heated by the heating conductor current, instead of or in addition to the main switch element. For example, several heating circuits can be arranged within the radiating heating elements, which together or partially during the heat-up phase are driven in parallel connection and which through the switch element, after a preselected time or after reaching a preselected temperature are totally or partially switched over to a series connection and thus to a reduced output. The switch element can be a heated bi-metal switch which is heated by the heating conductor current, and through which occurs in accordance with its preselected switching characteristic, the switching from parallel to series connection. Alternatively, a bi-metal switch can be placed in or on the radiating heating element, the switch being heat activated through the warming of the heating element or heat conductor and thus, according to a preselected switching characteristic, effects the switching from parallel to series connection.

In another advantageous arrangement of a cooking range according to the present invention, a series resistance with a positive temperature coefficient is connected in series as a switch element of one or more heating circuits, which initially allows a high current, but with increasing warmth decreases the current and thereby the glowing of the heating conductors by increased resistance. In this arrangement of the cooking range, the heating circuit can be fitted with appropriate matching series resistance in the outer area of the heating element.

In yet another arrangement of a cooking range according to the present invention, a time driven or controlled unit is used as a switching element, which after the passing of a preselected time period effects a reduction in heating output by means of suitably devised switch elements. In each of the possible arrangements, suitable wiring of the heating conductor and/or use of suitable control elements results in the switching to the highest output level results only during the initial heat-up phase after the switching on of the control element.

The invention can be universally realized with all types of radiating heating elements, whether single-circuit or multi-circuit heating elements, and can be combined with common control elements of radiating heating elements. The costs of such solutions are meaningfully cheaper than those of heating elements with halogen lamps. After switching on these heating elements, the heating conductors glow within seconds and are visible through the cooking surface. At the same time, immediately after switching on, one can feel the heat generated through the glowing heat conductor above the cooking surface, which strengthens the impression of a lightning-speed heating.

BRIEF DESCRIPTION OF THE DRAWINGS

The invention is more closely illustrated by means of the drawings in which.

DETAILED DESCRIPTION OF THE DRAWINGS

Figure 1:
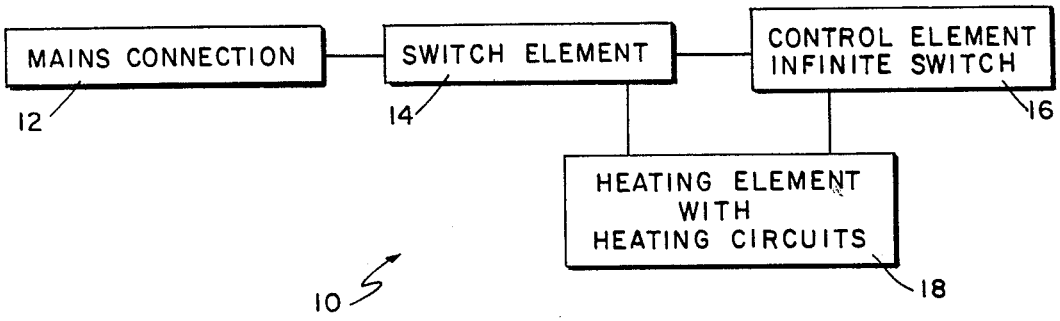
FIG. 1 is a block diagram for a cooking range according to the invention.

A cooking range 10 according to the present invention is shown in FIG. 1 to comprise a mains connection 12 which is connected to a conventional source of power for operation of the cooking range, for example 220 volts. A plurality of switch elements 14 are connected to the mains connection. Only a single switch element 14 is illustrated in FIG. 1 for sake of simplicity. A control element 16, which can be a infinite switch, is connected to the switch element in such a manner as to control the wattage of the heating element subsequent to the initial warm-up phase discussed herein.

The heating element 18 according with the present invention includes a heating or warm-up circuit which is arranged such that the heating element is briefly operated in an overload condition so as to begin to visibly glow in a very short time. The circuit is also arranged such that after this short time the current level is reduced so as to prevent any damage to the heating circuit by virtue of the overloaded initial condition.

Figure 2:
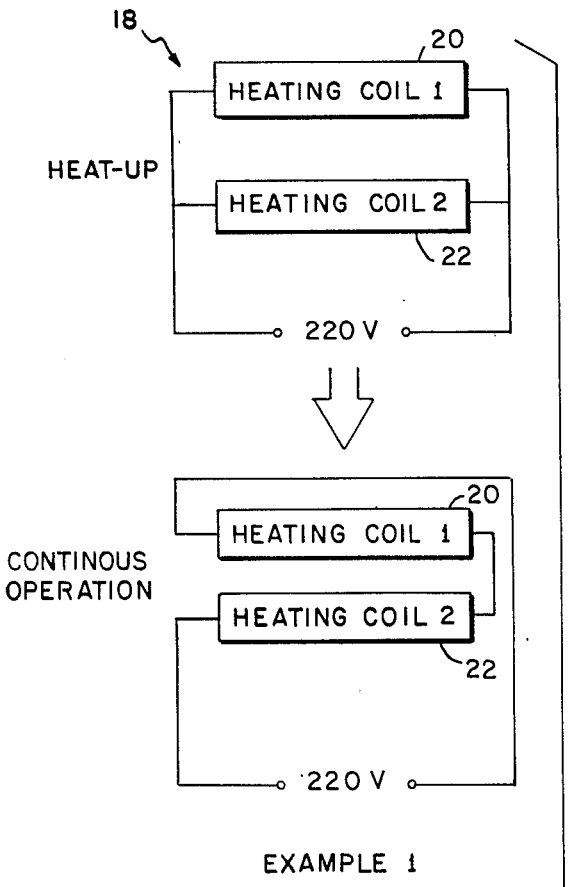
FIG. 2 shows schematically the operation of the heating circuits in the warm-up phase and during the regular operation for a first example.

A first example of the operation of a heating element 18 with heating circuit is shown in FIG. 2. The heating element 18 is shown to comprise a first heating coil 20 and a second heating coil 22 which are connected in parallel during the initial warm-up period to the 220 volt power source. At the end of an initial period of time or once a minimum temperature has been achieved, the heating coils 20 and 22 are switched from parallel to series for regular operation. The inherent resistance of the heater coils naturally decreases the amount of current flowing through the coils thereby insuring that the initial overload condition is replaced by a normal operating condition.

Figure 3:
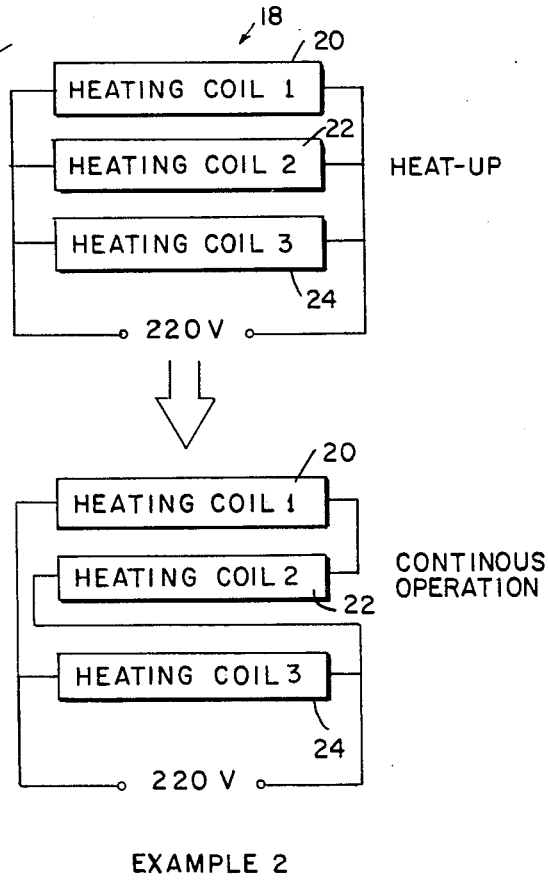
FIG. 3 shows schematically the operation of the heating circuits in the warm-up phase and during the regular operation for a second example.

A second example of the operation of a heating element 18 is schematically shown in FIG. 3 where heating coils 20 and 22 are connected in parallel to each other and in parallel with a third heating coil 24 during the warm-up phase. Subsequent to warm-up, heating coils 20 and 22 are switched to a series arrangement with each other but remain in parallel with heating coil 24. Again the overall circuit resistance as viewed from the 220 volt source of power has increased thus decreasing the total current delivered to the heating elements 20 and 22.

Figure 4:
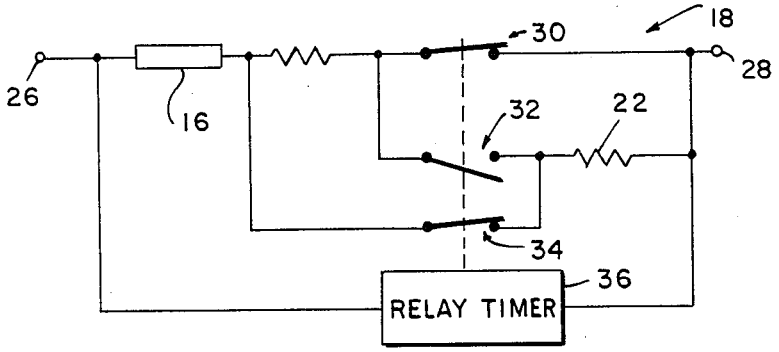
FIG. 4 shows a schematic diagram of a circuit operating in accordance with the first example.

FIG. 4 shows a simple schematic which will operate in the manner indicated in FIG. 2. Heating element 20 and heating element 22 are shown as resistors. The 220 volt source of power shown in FIG. 2 would be attached to terminals 26 and 28 through appropriate switch elements 14, control elements 16 and mains connection 12 as indicated in FIG. 1. The heating elements 18 includes a quick heating circuit including switch elements 30, 32 and 34. These switch elements 30, 32 and 34 are commonly controlled, for example, by relay-timer 36. The relay-timer 36 automatically resets to zero in the absence of power being applied to terminals 26 and 28. In the absence of power, the switches 30, 32 and 34 are arranged in the positions shown in FIG. 4.

Upon application of power to terminals 26 and 28, current is applied in parallel to resistor 20 through switch element 30 and to resistor 22 through switch element 34. After an appropriate delay, for example from about 5 to 20 seconds, the timer relay opens switch elements 30 and 34 and simultaneously closes switch element 32. This has the effect of permitting current to flow through resistors 20 and 22 in series through switch element 32. This condition remains so long as power is applied to terminals 26 and 28. When the power is removed from terminals 26 and 28, the relay timer 36 resets to its original position as shown in FIG. 4.

Figure 5:
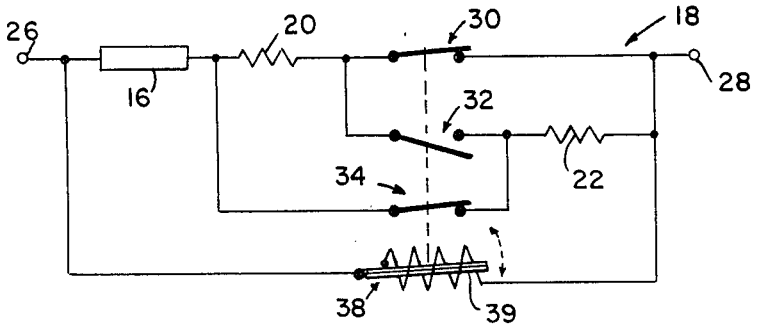
FIG. 5 shows a schematic diagram of a circuit operating in accordance with the second example.

FIG. 5 schematically illustrates a circuit operating in accordance with the diagram of FIG. 3. In FIG. 5, an additional resistance 39 is employed to heat a bi-metallic strip 38. The bi-metallic strip 38 is physically connected to the switching elements 30, 32 and 34 such that when appropriate heating has occurred through resistor 39 the switch elements 30, 32 and 34 move from the illustrated condition where resistors 20 and 22 are powered in parallel to the condition where resistors 20 and 22 are powered in series through switch element 32. Again, this condition continues so long as power is applied to terminals 26 and 28 but would reset to its initial illustrated position after an appropriate cooling period depending upon the physical construction of bi-metallic strip 38.

Figure 6:
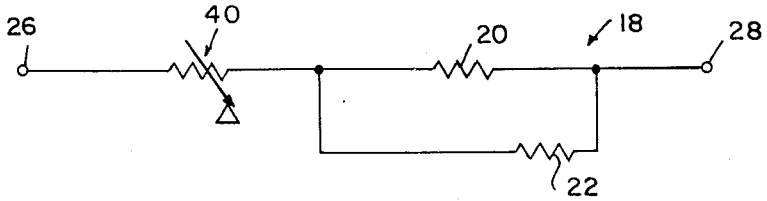
FIGS. 6 to 8 show schematic diagrams of yet other circuits operable in accordance with the present invention.

FIG. 6 illustrates yet another embodiment of the invention wherein the two heating elements 20 and 22 are permanently wired in parallel with each other. The pair of heating elements 20 and 22 are connected in series with a resistance 40 having a positive temperature coefficient such that resistor 40 allows a high current when cold but with increasing warmth decreases the current permitted to flow to heating elements 20 and 22.

Figure 7:
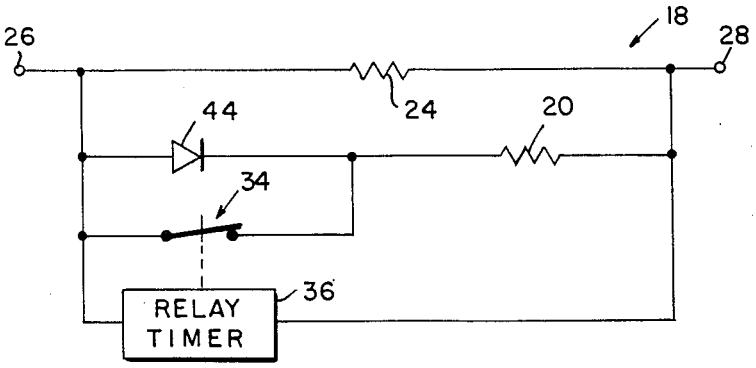

FIG. 7 schematically illustrates a circuit operating in accordance with the diagram of FIG. 3. In FIG. 7 an additional rectifier 44 (for example a semiconductor diode) is employed to reduce the wattage of the quick heating filament 20 after the heating-up phase. During the heating-up period the switch 34, controlled for example by a relay timer 36, applies both half waves of the alternating current to the heating element 20. After the heating-up phase only one half wave is applied to the filament 20. Heating element 24 is connected in parallel.

Figure 8:
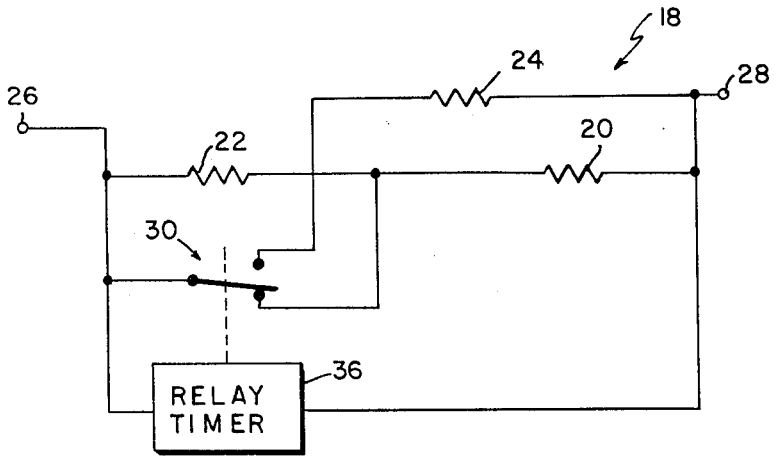

FIG. 8 illustrates a circuit in accordance with FIG. 3 with an almost constant power consumption, even during the heating-up period. The resistance values of the filaments 20 to 22 are thus balanced that filament 20 and the combination of filaments 20 to 22 have almost the same resistance. As an example the, in the heating-up period "quick heating" filament 20 can have the same value as 22 and the half value of 24. During the heating-up period switch 30 applies power only to the quick heating filament. After this period filament 20 is connected in series with filament 22, reducing power in both to one half. The other half of the power is dissipated by the parallel filament 24. Again switch 30 is controlled for example by a timer relay. The resistance values can also be choosen such that the power consumption during the heating-up period can be lower than the nominal power consumption. The ratio of the resistance values of 20 and 22 can be choosen such that any desirable overload factor for filament 20 is obtainable. In other designs the resistance values of the filaments can be choosen such that any desirable deviation of the wattage in the heating-up period from the continuous state can be adjusted.

Figure 9:
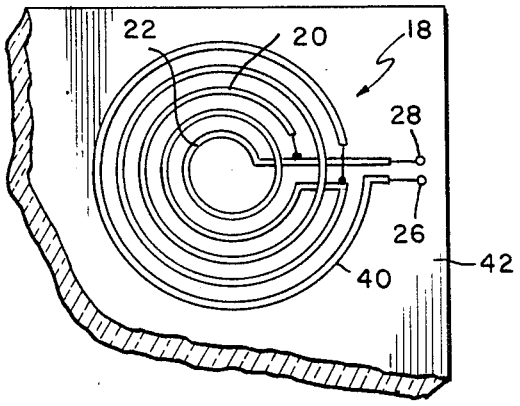
FIG. 9 shows a bottom plan view partially broken away of a cooking range surface and heating element incorporating the circuit shown in FIG. 6.

FIG. 9 illustrates a preferred embodiment for a heating element incorporating the resistance characteristics of the circuit shown in FIG. 6 wherein the thermally responsive series resistance 40 is situated in the outermost area of the heating element 18, the heating element 18 being mounted to the bottom of a glass-ceramic cooking surface 42 by conventional means.

Although the invention has been described in detail with references to certain preferred embodiments and specific examples, variations and modifications exist within the scope and spirit of the invention as described and as defined in the following claims.

What is claimed is:

1. A cooking range with translucent cooking surfaces made of glass ceramic or comparable material, the range having a radiating heating elements including heating conductors having a certain rated power output which glow at said rated output with at least two heating circuits with related control elements, characterized in that, the heating circuits associated with each radiating heating element are so designed that in a first heating-up phase, one or more heat conductors is overloaded above said rated output so that in less than 20 seconds the overloaded one or more heat conductors have their heating phase shortened and their glowing accelerated and thus, through the sufficiently translucent cooking surface, becomes luminous, each heating element including a suitably connected switch element which, after a preselected time or after a preselected temperature of the one or more heating conductors is reached, switches so that the heating output of one or more of the heating circuits is reduced to a lower output in such a way, that during the continuous operation of the radiating heating element following the heat-up phase a prolonged overloading of the heating conductor is avoided.

2. A cooking range according to claim 1, characterized in that, in addition to said switch element, an external switch, heated by the heating conductor current, is provided for.

3. A cooking range according to claim 1, characterized in that, several heating circuit arrangements are associated with the radiating heating elements, and wherein during the heat-up phase the heating elements are arranged in a parallel connection and wherein through the switch element, after a preselected time or after reaching a preselected temperature at least one heating element is switched over to a series connection with the other heating elements, thereby increasing the total resistance in eliminating the overload condition.

4. A cooking range according to claim 3 characterized in that, the switch element is a heated ec, bi-metal switch heated by the heating conductor current, through which, in accordance with its preselected switching characteristic, the switching from parallel to series connection follows.

5. A cooking range according to claim 3, characterized in that, a bi-metal switch is placed in or on the radiating heating element, which is warmed through the warming of the heating element or heat conductor and thus, according to a preselected switching characteristic, effects the switching from parallel to series connection.

6. A cooking range according to claim 1 characterized in that, a series resistance with positive temperature coefficient is connected in series as a switch element of one or more heating circuits, which to begin allows a high current, but with increasing warmth decreases the current and thereby the glowing of the heat conductor(s) by increased resistance.

7. A cooking range according to claim 6, characterized in that, the heating circuit is fitted with matching appropriate series resistance in the outer area of the heating element.

8. A cooking range according to claim 1, characterized in that, a time driven control unit is used as a switching element, which after the passing of a preselected time period effects a reduction in heating output by means of suitably devised switch elements.

9. A cooking range according to claim 1, characterized in that, by means of suitable wiring of the heating conductor or use of suitable control elements, the switching to the highest output level results only during the initial warm-up phase after the switching on of the control element.

10. A cooking range according to claim 1, characterized in that one or more heating conductors start to glow and, thus, become luminous in less than 5 seconds.

11. A cooking range according to claim 1 characterized in that, a rectifier is connected in series with at least one heating conductor as a wattage reducing element, which is short circuited during the heating-up phase by a switching element.

12. A cooking range according to claim 1, wherein the heating circuits are designed so that in the heating-up phase, the power consumption of a plurality of heating elements is equal to or smaller than their rated power for continuous operation, even though at least one of the heating conductors is operated in the overloaded condition.

13. A cooking range with translucent cooking surfaces made of glass-ceramic or comparable material, the range having radiating heating elements including heating conductors having a certain rated power output which glow at said rated output with at least two heating circuits with related control elements, characterized in that, the heating conductors of the radiating heating element are so wired or are connected by such circuitry that in a first heating-up phase, one or more heating conductors is overloaded above said rated output so that in less than 20 seconds the one or more heating conductors have their heating phase shortened and their glowing accelerated and thus, through the sufficiently translucent cooking surface, becomes luminous, each heating element including a suitably connected switch element which, after a preselected time or after a preselected temperature of one or more heating conductors is reached, switches so that the heating output of one or more of the heating circuits is reduced to a lower output in such a way, that during the continuous operation of the radiating heating element following the heat-up phase, a prolonged overloading of the heating conductor is avoided.

* * * * *